United States Patent [19]

Samuelson

[11] Patent Number: 4,667,828

[45] Date of Patent: May 26, 1987

[54] DISPENSER FOR A STACK OF SHEETS

[75] Inventor: Bruce E. Samuelson, West Lakeland Township, Washington County, Minn.

[73] Assignee: Minnesota Mining and Manufacturing Company, Saint Paul, Minn.

[21] Appl. No.: 868,355

[22] Filed: May 29, 1986

[51] Int. Cl.[4] ..... B65D 1/34

[52] U.S. Cl. ..... 206/555; 206/482; 206/554

[58] Field of Search ..... 206/555, 477, 478, 480, 206/481, 482, 483, 486, 487, 488, 489, 554, 494

[56] References Cited

U.S. PATENT DOCUMENTS

| | | | |
|---|---|---|---|
| 3,811,565 | 5/1974 | Tancredi | 206/478 |
| 4,261,466 | 4/1981 | Wilford | 206/480 |
| 4,350,249 | 9/1982 | Caston | 206/486 |
| 4,354,597 | 10/1982 | Garrod | 206/487 |
| 4,422,552 | 12/1983 | Palmer et al. | 206/482 |

*Primary Examiner*—Joseph M. Moy

*Attorney, Agent, or Firm*—Donald M. Sell; James A. Smith; William L. Huebsch

[57] ABSTRACT

A dispenser for holding a pad or stack of paper sheets joined by bands of pressure-sensitive adhesive along one edge portion of each sheet. The dispenser includes a support surface for the pad, and means for holding the bottom sheet to the support surface comprising a slot communicating with the support surface through which the bottom sheet on the pad passes, and a clip which attaches that bottom sheet to a rib on the dispenser to retain its position through the slot.

2 Claims, 7 Drawing Figures

Fig. 3
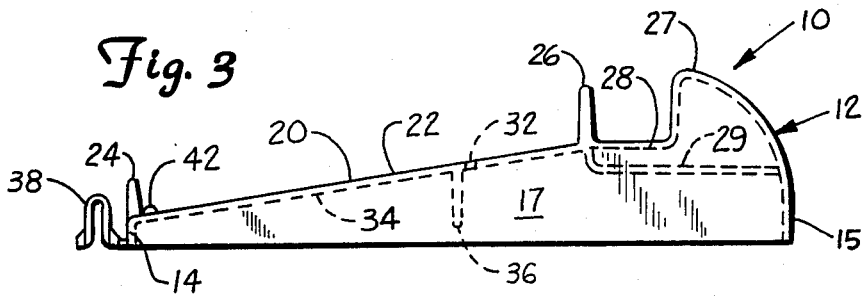
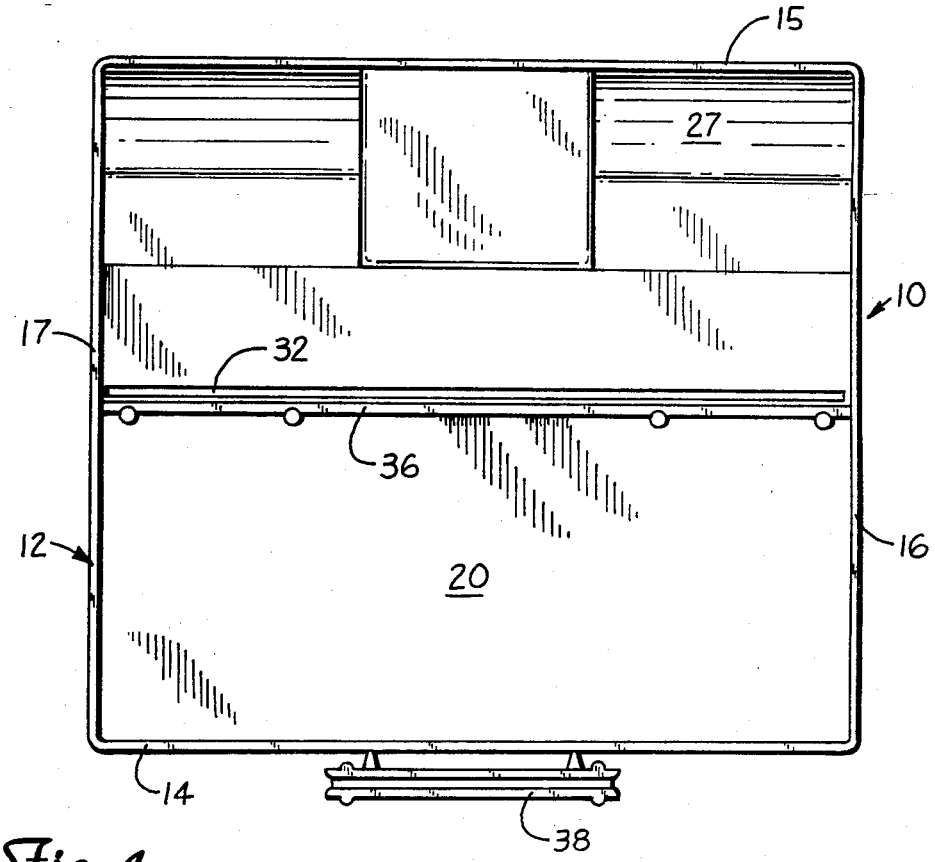
Fig. 4

DISPENSER FOR A STACK OF SHEETS

TECHNICAL FIELD

The present invention relates to means for attaching to a dispenser a stack of sheets bound together by narrow bands of readily repositionable pressure-sensitive adhesive coated along edge portions of the sheets.

DESCRIPTION OF THE PRIOR ART

Commercially available from the assignee of this application, Minnesota Mining and Manufacturing Company, are pads or stacks of paper sheets in which each sheet is coated along an edge portion with a narrow band (i.e. one quarter to three quarters of an inch wide) of readily releasable pressure-sensitive adhesive, and the sheets are stacked with their adhesive coated edge portions positioned above each other. The individual sheets may be readily removed from the stack by peeling the sheet and its adhesive from the next sheet in the stack, and the readily repositionable pressure-sensitive adhesive allows the separated sheet to then be attached to another sheet or other receptor surface and to subsequently be removed without tearing the sheet or the fibers of the other sheet or receptor surface.

U.S. Pat. No. Des. 273,798 illustrates a dispenser adapted to support such a stack of sheets so that individual sheets can be conveniently removed. That dispenser has a surface for supporting the stack of sheets and relies on the adhesive on the surface of the bottom sheet in the stack or on an additional strip of adhesive to secure the stack of sheets to the support surface on the dispenser. After several uses of that dispenser, however, the support surface can become soiled or the strip of adhesive applied to the dispenser can become contaminated such that the stack of sheets will not be securely enough held on the dispenser to permit separation of one sheet from the stack without also separating the entire stack from the holder, particularly after most of the sheets have already been removed from the stack.

U.S. patent application Ser. No. 793,481 filed Oct. 29, 1985, describes several embodiments of a dispenser which provides a support surface for a stack or pad of sheets; includes means for holding the bottom sheet in such a stack against movement in the plane of the support surface (which means in one embodiment (FIG. 10) includes a slot through the support member defining the support surface which receives at least the bottom sheet in the stack); and provides an abutment which projects above the plane of the support surface along one edge of the support surface and is adapted for engagement with an end of such a stack of sheets opposite its end joined together by the narrow bands of adhesive to restrict movement of the stack during separation of the uppermost sheet from the stack, thereby restricting peeling forces from being applied to the bands of adhesive on the lowermost sheets.

DISCLOSURE OF THE INVENTION

The present invention provides a simple dispenser for a pad or stack of sheets of the type described above, which dispenser includes a simple and positive means for holding the bottom sheet in a stack against movement in the plane of the support surface so that sheets can be individually removed from the top of the stack without separating the stack from the dispenser.

According to the present invention there is provided a dispenser for a stack of sheets in which sheets are joined to form the stack by a narrow band of pressure-sensitive adhesive on a portion of the back surface of each sheet adjacent one edge, which adhesive affords removing a single sheet from the stack by separating the adhesive coated end of that single sheet from the remaining sheets in the stack. The dispenser comprises (1) a support member having a generally planar support surface for such a stack of sheet material; and (2) means for attaching at least the bottom sheet in the stack to the support member comprising the support member having a through slot extending transverse to the support surface adapted to receive a portion of that bottom sheet projecting generally at right angles to the support surface with a distal portion of that bottom sheet adjacent the back surface of the support member, a rib projecting from the back surface of the support member, and a spring clip adapted for frictional engagement over the rib with the distal portion of that bottom sheet between the clip and the rib.

DESCRIPTION OF THE DRAWING

The present invention will be further described with reference to the accompanying drawing wherein like reference numerals refer to like parts in the several views and wherein:

FIG. 3 is a side view of the dispenser of FIG. 1;

FIG. 4 is a bottom view of the dispenser of FIG. 1;

DESCRIPTION OF THE PREFERRED EMBODIMENTS

Figure 1:
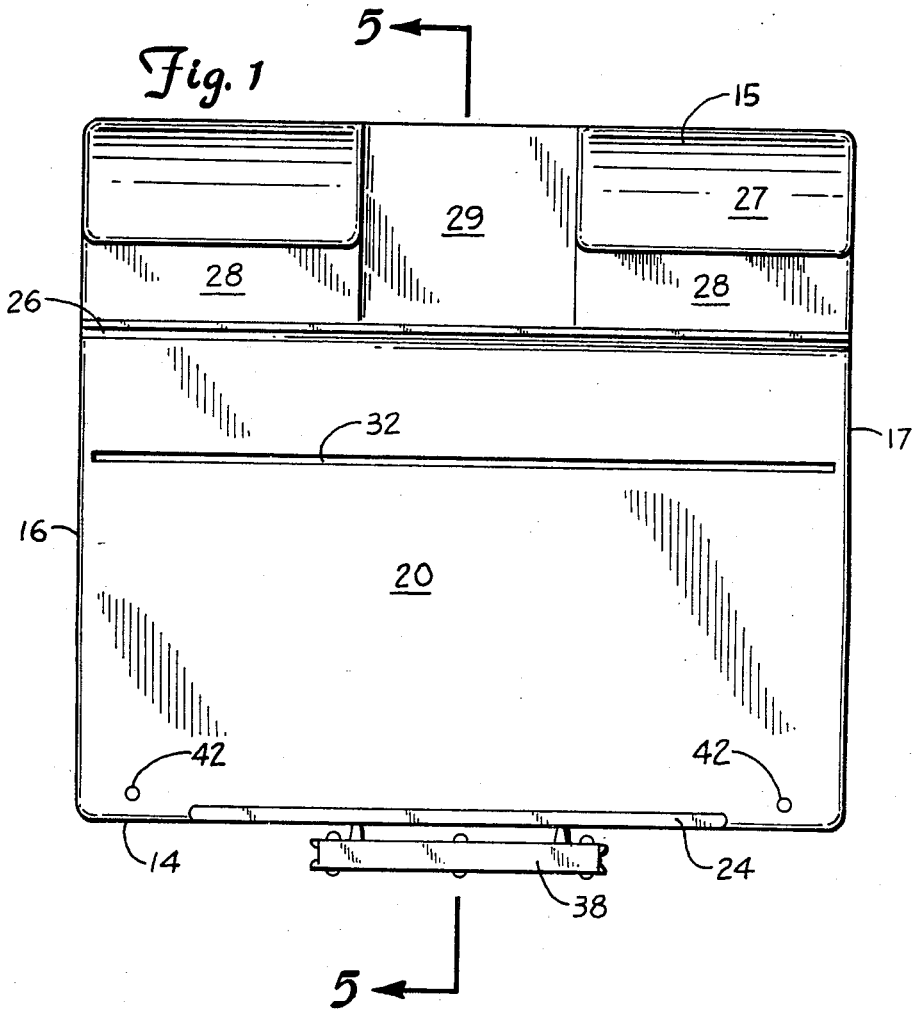
FIG. 1 is a top view of a dispenser for a stack of sheets according to the present invention.
Figure 2:
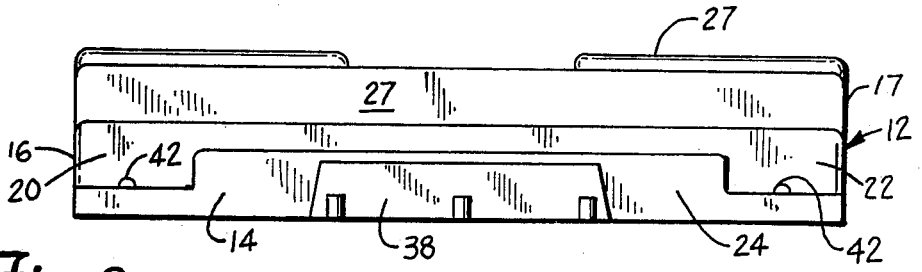
FIG. 2 is a front view of the dispenser of FIG. 1.
Figure 5:
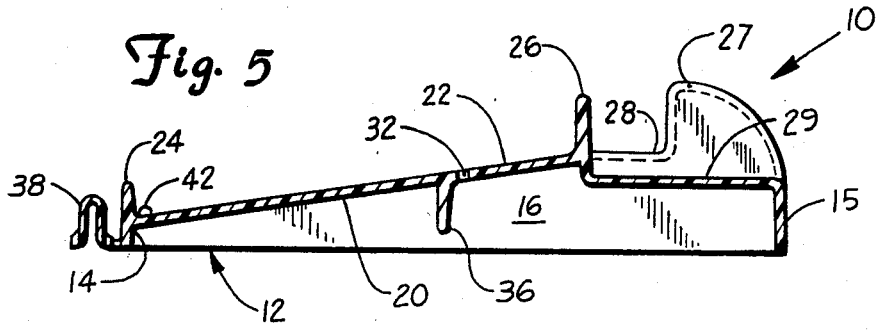
FIG. 5 is a vertical sectional view taken approximately along line 5—5 of FIG. 1.

Referring now to the drawing, there is illustrated a dispenser according to the present invention, which dispenser is generally designated by the reference numeral 10, and is particularly adapted to accept a note pad or stack of sheets 11 of the type comprising paper sheets (e.g., approximately twenty pound bond paper) with each sheet coated on its back surface along one edge in a band about one-quarter to three-quarters of an inch wide with a readily repositionable pressure-sensitive adhesive (e.g., Post-it TM brand note pads available from Minnesota Mining and Manufacturing Company, St. Paul, Minn.).

The dispenser 10 comprises a frame 12 which is integrally molded of a polymeric material and includes a front wall 14, a rear wall 15, and opposed side walls 16 and 17 between which extend a generally planar support member 20 having a planar support surface 22 for supporting the stack of sheets 11. The support member 20 extends from an abutment 24 along the front wall 14 of the dispenser 10 to a spaced parallel vertical member 26. The abutment 24 projects above the support surface 22, helps to locate the stacks of sheets 11 on the support surface 22, and may, as taught in U.S. patent application Ser. No. 793,481 (incorporated herein by reference), engage the edges of sheets in the stack 11 opposite their adhesive coated edge portions to help restrict movement of the stack of sheets 11 with respect to the support 20 during separation of the uppermost sheet in the stack. The vertical member 26 also projects above the support surface 22, is adapted to be positioned along the adhesively joined edges of sheets in the stack 30 of sheet material, and cooperates with a top portion 27 of the dispenser 10 to form a cradle 28 for a writing instrument and a recessed planar area 29 which affords finger access to a writing instrument in the cradle 28 and may support a nameplate, advertising, etc.

Attaching means are provided for attaching at least one bottom sheet 30 in the stack of sheets 11 to the support member 20. The attaching means comprises the support member 20 having a through slot 32 extending at a right angle to the side walls 16 and 17 and transverse to the support surface 22 at a location spaced about three-quarters of an inch from the adhesively joined end of the stack of sheets 11, which is normally past the strips of adhesive by which the stack of sheets 11 is joined. The slot 32 is adapted to receive a portion of the bottom sheet 30 projecting generally at right angles to the support surface 22 with a distal portion of the bottom sheet 30 adjacent a back surface 34 of the support member 20. Additionally, the attaching means comprises a rib 36 included in the frame 12, projecting from the back surface 34 of the support member 20, and extending parallel to and closely adjacent the slot 32 on the side of the slot 32 adjacent the abutment 24; and a spring clip 38 having a generally U-shaped cross section and being adapted for frictional engagement over the rib 36 with part of the distal portion of the bottom sheet 30 between the clip 38 and the rib 36.

Preferably, as illustrated, the clip 38 is integrally molded with the frame 12 along the front wall 14, and the clip 38 is easily separable by breaking it away from the front wall 14 to afford frictional engagement of the clip 38 over the rib 36.

The frame 12 also includes two spaced generally hemispherical projections 42 on the support member 20 adjacent the ends of the abutment 24 that contact and slightly elevate (e.g., by 0.05 inch) the end of the stack of sheets 11 opposite its end joined together by narrow banks of adhesive so that a user may conveniently engage the free end of the uppermost sheet in the stack 11 with his fingers to remove it even after most of the sheets have already been removed.

Figure 6:
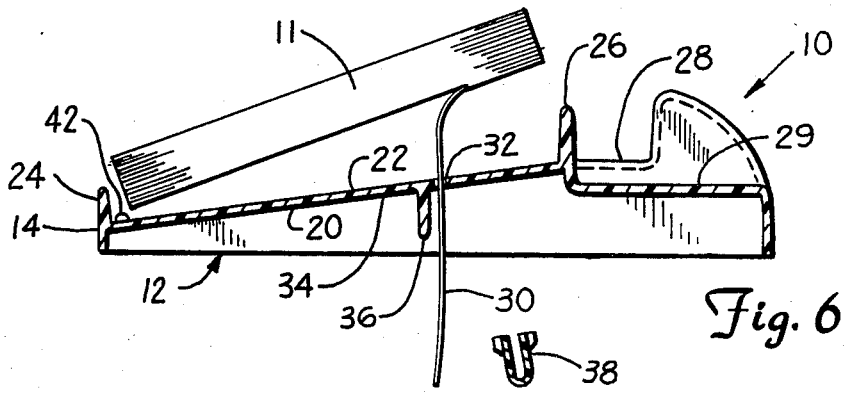
FIGS. 6 and 7 are vertical sectional views taken generally along line 5—5 of FIG. 1 sequentially illustrating application of a clip to attach a stack of sheets to the dispenser of FIG. 1.
Figure 7:
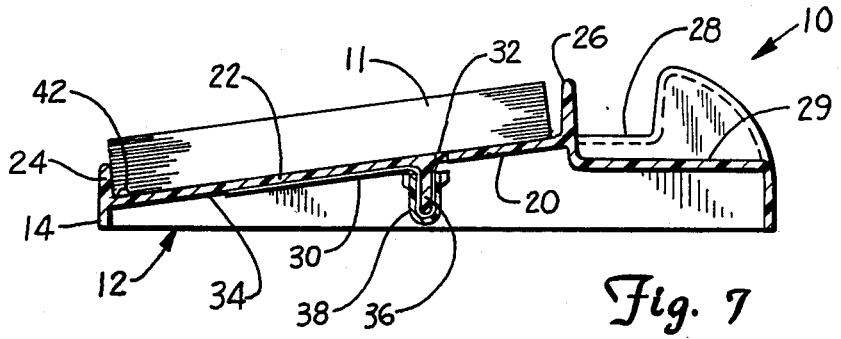

To fasten the stack of sheets 11 to the dispenser 10, a person first positions the stack of sheets 11 on the support surface 22 with its adhesively joined edge adjacent the vertical member 26, after transversely folding its bottom sheet 30 at about a right angle and inserting it through the slot 32 in the support member 20 so that the distal end of the bottom sheet 30 is adjacent the back surface 34 of the support member 20 (FIG. 6). The person then presses the clip 38 over the rib 36 with the distal portion of the bottom sheet 30 therebetween to complete the fastening procedure (FIG. 7). Subsequently, individual sheets may be peeled away from the top of the stack 11, whereupon the end of the stack of sheets opposite its end adhesively joined together can engage the abutment 24 to restrict movement of the stack 11 during separation of the uppermost sheet from the stack, thereby restricting peeling forces from being applied to the bands of adhesive on the lowermost sheets in the stack 11.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

I claim:

1. A dispenser for a stack of sheet material comprising sheets joined to form the stack by a narrow band of pressure-sensitive adhesive on one side of each sheet adjacent one end which adhesive affords removing a single sheet from the stack by separating the adhesive coated end of the single sheet from the remaining sheets in the stack, said dispenser comprising:

a support member having a back surface and having a generally planar support surface for a said stack of sheet material; and means for attaching at least one sheet in a said stack to the support member comprising said support member having a through slot extending transverse to said support surface adapted to receive a portion of said one sheet projecting generally at right angles to said support surface with a distal portion of said one sheet adjacent the back surface of said support member, a rib projecting from the back surface of said support member, and a spring clip adapted for frictional engagement over said support member with the distal portion of said one sheet between said clip and said rib.

2. A dispenser according to claim 1 wherein said dispenser including said clip is an integral molding, said clip being separable to afford frictional engagement thereof over said rib.

* * * * *